US011289043B2

(12) United States Patent
Zheng

(10) Patent No.: US 11,289,043 B2
(45) Date of Patent: Mar. 29, 2022

(54) GATE DRIVER ON ARRAY CIRCUIT AND THIN-FILM TRANSISTOR SUBSTRATE

(71) Applicant: SHENZHEN CHINA STAR OPTOELECTRONICS SEMICONDUCTOR DISPLAY TECHNOLOGY CO., LTD., Shenzhen (CN)

(72) Inventor: Xuhuang Zheng, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 207 days.

(21) Appl. No.: 16/624,573

(22) PCT Filed: Nov. 8, 2019

(86) PCT No.: PCT/CN2019/116658

§ 371 (c)(1),
(2) Date: Dec. 19, 2019

(87) PCT Pub. No.: WO2020/238040

PCT Pub. Date: Dec. 3, 2020

(65) Prior Publication Data

US 2021/0335308 A1 Oct. 28, 2021

(30) Foreign Application Priority Data

May 31, 2019 (CN) ..... 201910469455.0

(51) Int. Cl.
*G09G 3/36* (2006.01)

(52) U.S. Cl.
CPC ... *G09G 3/3677* (2013.01); *G09G 2300/0408* (2013.01); *G09G 2310/08* (2013.01)

(58) Field of Classification Search
None
See application file for complete search history.

(56) References Cited

U.S. PATENT DOCUMENTS

2018/0268768 A1* 9/2018 Lv ..... G11C 19/28

FOREIGN PATENT DOCUMENTS

WO WO2018072288 * 4/2018 ..... G09G 3/3677

* cited by examiner

*Primary Examiner* — Ifedayo B Iluyomade
(74) *Attorney, Agent, or Firm* — Dickinson Wright PLLC

(57) ABSTRACT

The present disclosure provides a gate driver on array (GOA) circuit and a thin-film transistor substrate. The GOA circuit includes a plurality of cascaded GOA units. Each stage of the GOA units includes: a pull-up control module, a pull-up module, a bootstrap module for raising a voltage potential of a pull-up control signal, a control module for transmitting the raised voltage potential of the pull-up control signal to a scan signal of a present stage to raise the voltage potential of the scan signal of the present stage, a pull-down module, and a pull-down holding module.

18 Claims, 1 Drawing Sheet

GATE DRIVER ON ARRAY CIRCUIT AND THIN-FILM TRANSISTOR SUBSTRATE

FIELD OF INVENTION

The present disclosure relates to the field of display panel technologies, and more particularly, to a gate driver on array (GOA) circuit and a thin-film transistor (TFT) substrate.

BACKGROUND OF INVENTION

GOA driving methods, which drive gates row by row, arrange gate scan driving circuit on an array substrate by utilizing array fabrication of existing TFT liquid crystal display.

In present GOA circuits, a capacitor is disposed between a pull-up control signal outputted by a pull-up control module and a scan signal outputted by a pull-up module. When the scan signal is at a high voltage potential, the capacitor bootstrap a voltage potential of the pull-up control signal to make a voltage potential of the scan signal outputted by the pull-up module high enough. However, the voltage potential of the outputted scan signal may not be high enough due to a limitation of bootstrap performance if only the capacitor is adopted for bootstrapping.

Technical Problems

The present disclosure provides a GOA circuit and a TFT substrate to solve problems that the voltage potentials of the scan signals outputted by the existing GOA circuits are not high enough.

SUMMARY OF INVENTION

The present disclosure provides a gate driver on array (GOA) circuit comprising a plurality of cascaded GOA units. Each of the GOA units comprising:

A pull-up control module is configured to output a pull-up control signal being at a high voltage potential according a first clock signal and a scan signal of a previous stage when a scan starts.

A pull-up module is configured to output a scan signal of a present stage being at a high voltage potential according to a second clock signal and the pull-up control signal.

A bootstrap module is configured to pull-up a voltage potential of the pull-up control signal according to the scan signal of the present stage being at the high voltage potential.

A control module is configured to pull-up a voltage potential of the scan signal of the present stage by transmitting a pulled up voltage potential of the pull-up control signal to the scan signal of the present stage.

A pull-down module is configured to pull-down the voltage potential of the pull-up control signal and the voltage potential of the scan signal of the present stage to a low voltage potential when the scan is completed.

A pull-down holding module is configured to maintain the voltage potential of the pull-up control signal and the voltage potential of the scan signal of the present stage at the low voltage potential.

More particularly, the control module is further configured to be turned on after a delayed first predetermined duration when the pull-up control module outputs the pull-up control signal being at the high voltage potential, and is further configured to pull-up the voltage potential of the scan signal of the present stage by transmitting the pulled up voltage potential of the pull-up control signal to the scan signal of the present stage after the voltage potential of the pull-up control signal is pulled up.

More particularly, the control module is further configured to be turned off after a delayed second predetermined duration when the voltage potential of the pull-up control signal changes from the high voltage potential to the low voltage potential, and is configured to pull-down the scan signal of the present stage to the low voltage potential together with the pull-down module within the delayed second predetermined duration.

More particularly, the control module comprises a capacitor and a first switch transistor.

The control module is further configured to turn on the first switch transistor after the delayed first predetermined duration affected by the capacitor when the pull-up control signal changes from the low voltage potential to the high voltage potential. The first switch transistor transmits the pulled up voltage potential of the pull-up control signal to the scan signal of the present stage.

The first switch transistor is turned off after the delayed second predetermined duration affected by the capacitor when the pull-up control signal changes from the high voltage potential to the low voltage potential, and the first switch transistor pulls down the scan signal of the present stage to the low voltage potential together with the pull-down module within the delayed second predetermined duration.

More particularly, one end of the capacitor receives the pull-down control signal and another end of the capacitor is connected to a gate of the first switch transistor, a source of the first switch transistor is connected to the pull-down control signal, and a drain of the first switch transistor receives the scan signal of the present stage.

More particularly, the bootstrap module comprises a bootstrap capacitor.

One end of the bootstrap capacitor receives the pull-up control signal and another end of the bootstrap capacitor receives the scan signal of the present stage.

More particularly, the pull-up control module comprises a second switch transistor.

A gate of the second switch transistor receives the first clock signal, a source of the second switch transistor receives the scan signal of the previous stage, and a drain of the second switch transistor outputs the pull-up control signal.

More particularly, the pull-up module comprises a third switch transistor.

Agate of the third switch transistor receives the pull-up control signal, a source of the third switch transistor receives the second clock signal, and a drain of the third switch transistor outputs the scan signal of the present stage.

More particularly, the pull-up module comprises a fourth switch transistor.

A gate of the fourth switch transistor is connected to the pull-down hold module, a source of the fourth switch transistor receives the scan signal of the present stag, and a drain of the fourth switch transistor receives a low voltage potential signal.

More particularly, the pull-down holding module comprises a fifth switch transistor, a sixth switch transistor, and a seventh switch transistor.

A gate of the fifth switch transistor and a drain of the fifth switch transistor receive a high voltage potential signal, a source of the fifth switch transistor is connected to the gate of the fourth switch transistor, a gate of the sixth switch transistor, and a source of the seventh switch transistor, a source of the sixth switch transistor receives the pull-up control signal, a drain of the sixth switch transistor receives the low voltage potential signal, a gate of the seventh switch transistor receives the pull-up control signal, and a drain of the seventh switch transistor receive the low voltage potential signal.

The present disclosure further provides a thin-film transistor (TFT) substrate comprising a GOA circuit. The GOA circuit comprises a plurality of cascaded GOA units, and each of the GOA units comprises.

A pull-up control module is configured to output a pull-up control signal being at a high voltage potential according a first clock signal and a scan signal of a previous stage when a scan starts.

A pull-up module is configured to output a scan signal of a present stage being at a high voltage potential according to a second clock signal and the pull-up control signal.

A bootstrap module is configured to pull-up a voltage potential of the pull-up control signal according to the scan signal of the present stage being at the high voltage potential.

A control module is configured to pull-up a voltage potential of the scan signal of the present stage by transmitting a pulled up voltage potential of the pull-up control signal to the scan signal of the present stage.

A pull-down module is configured to pull-down the voltage potential of the pull-up control signal and the voltage potential of the scan signal of the present stage to a low voltage potential when the scan is completed.

A pull-down holding module is configured to maintain the voltage potential of the pull-up control signal being at the low voltage potential and the voltage potential of the scan signal of the present stage at the low voltage potential.

More particularly, the control module is further configured to be turned on after a delayed first predetermined duration when the pull-up control module outputs the pull-up control signal being at a high voltage potential, and is further configured to pull-up the voltage potential of the scan signal of the present stage by transmitting the pulled up voltage potential of the pull-up control signal to the scan signal of the present stage after the voltage potential of the pull-up control signal is pulled up.

More particularly, the control module is further configured to be turned off after a delayed second predetermined duration when the voltage potential of the pull-up control signal changes from the high voltage potential to the low voltage potential, and is configured to pull-down the scan signal of the present stage to the low voltage potential together with the pull-down module within the delayed second predetermined duration.

More particularly, the control module comprises a capacitor and a first switch transistor.

The control module is further configured to turn on the first switch transistor after the delayed first predetermined duration affected by the capacitor when the pull-up control signal changes from the low voltage potential to the high voltage potential, wherein the first switch transistor transmits the pulled up voltage potential of the pull-up control signal to the scan signal of the present stage.

The first switch transistor is turned off after the delayed second predetermined duration affected by the capacitor when the pull-up control signal changes from the high voltage potential to the low voltage potential, and the first switch transistor pulls down the scan signal of the present stage to the low voltage potential together with the pull-down module within the delayed second predetermined duration.

More particularly, one end of the capacitor receives the pull-down control signal and another end of the capacitor is connected with a gate of the first switch transistor, a source of the first switch transistor is connected with the pull-down control signal, and a drain of the first switch transistor receives the scan signal of the present stage.

More particularly, the bootstrap module comprises a bootstrap capacitor.

One end of the bootstrap capacitor receives the pull-up control signal and another end of the bootstrap capacitor receive the scan signal of the present stage.

More particularly, the pull-up control module comprises a second switch transistor.

A gate of the second switch transistor receives the first clock signal, a source of the second switch transistor receives the scan signal of the previous stage, and a drain of the second switch transistor outputs the pull-up control signal.

More particularly, the pull-up module comprises a third switch transistor.

A gate of the third switch transistor receives the pull-up control signal, a source of the third switch transistor receives the second clock signal, and a drain of the third switch transistor outputs the scan signal of the present stage.

More particularly, the pull-up module comprises a fourth switch transistor.

A gate of the fourth switch transistor is connected to the pull-down hold module, a source of the fourth switch transistor receives the scan signal of the present stag, and a drain of the fourth switch transistor receives a low voltage potential signal.

More particularly, the pull-down holding module comprises a fifth switch transistor, a sixth switch transistor and a seventh switch transistor.

A gate of the fifth switch transistor and a drain of the fifth switch transistor receive a high voltage potential signal, a source of the fifth switch transistor is connected to the gate of the fourth switch transistor, a gate of the sixth switch transistor, and a source of the seventh switch transistor, a source of the sixth switch transistor receives the pull-up control signal, a drain of the sixth switch transistor receives the low voltage potential signal, a gate of the seventh switch transistor receives the pull-up control signal, and a drain of the seventh switch transistor receive the low voltage potential signal.

Beneficial Effects

The beneficial effects of the present disclosure is: enhancing the stability of the GOA circuit by disposing the control module between the pull-up control signal and the scan signal of the present stage, thereby the voltage potential of the scan signal of the present stage is pulled up because the voltage potentials of the pull-up control signal is pulled up by the bootstrap module. When the pull-up control signal changes from the high voltage potential to the low voltage potential, the control module is turned off after delay for a predetermined duration so than the pull-down module pull-down the scan signal of the present disclosure to the low voltage potential together with the control module during the delay duration. As a result, the pull-down efficiency of the scan signal of the present stage is improved.

DESCRIPTION OF DRAWINGS

In order to clarify the technical solutions of embodiments of the present disclosure, drawings required to describe the embodiments are briefly illustrated. Obviously, the mentioned embodiments are only parts of the embodiments instead of all of the embodiments. Other embodiments that can be obtained by a skilled person in the art without creative effort fall in the protected scope of the present disclosure.

DETAILED DESCRIPTION OF PREFERRED EMBODIMENTS

Figure 1:
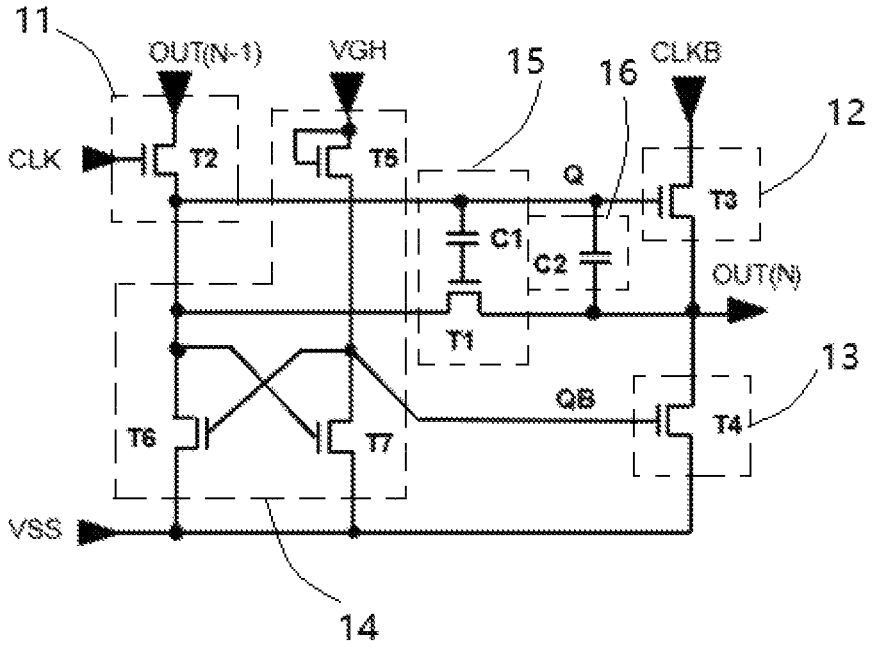
FIG. 1 illustrates a structural diagram of a gate driver on array (GOA) circuit of an embodiment of the present disclosure.

The following description of the various embodiments is provided with reference of drawings to illustrate specific embodiments. Directional terms mentioned in the present disclosure, such as upper, lower, front, back, left, right, inside, outside, lateral, etc., are only referring to the direction of the drawing. Therefore, the directional terms used to describe and clarify the present disclosure should not be viewed as limitations of the present disclosure. In the drawing, structurally similar elements are denoted by the same reference numbers.

Please refer to FIG. 1 which illustrates a structural diagram of a gate driver on array (GOA) circuit of an embodiment of the present disclosure.

The present disclosure provides a plurality of cascaded GOA units. Each stage of the GOA units includes a pull-up control module 11, a pull-up module 12, a pull-down module 13, a pull-down holding module 14, a control module 15, and a bootstrap module 16.

The pull-up control module 11 is configured to output a pull-up control signal Q at a high voltage potential according to a first clock signal CLK and a scan signal of a previous stage OUT(N−1) when a scan starts.

In this embodiment, when the scan starts, the pull-up control module 11 inputs the first clock signal CLK at a high voltage potential and the scan signal of the previous stage OUT(N−1) of high potential. The pull-up control module 11 is turned on, and outputs the pull-up control signal Q at the high voltage potential. When the scan is completed, the pull-up control module 11 inputs the first clock signal CLK at the high voltage potential and the scan signal of the previous stage OUT(N−1) at a low potential. The pull-up control module 11 is turned on and outputs the pull-up control signal Q at a low voltage potential. The pull-up control signal Q is utilized to control the on and off of the pull-up module 12.

More particularly, the pull-up control module 11 includes a second switch transistor T2.

A gate of the second switch transistor T2 is connected to the first clock signal CLK. A source of the second switch transistor T2 is connected to the scan signal of the previous stage OUT(N−1). A drain of the second switch transistor T2 outputs the pull-up control signal Q.

It should be noted that when the scan starts, the gate of the second switch transistor T2 receives the first clock signal CLK at the high voltage potential. The source of the second switch transistor T2 receives the scan signal of the previous stage OUT(N−1). The second switch transistor T2 is turned on. The source of the second switch transistor T2 outputs the pull-up control signal Q at the high voltage potential. Then, the gate of the second switch transistor T2 receives the first clock signal CLK at the low voltage potential. The source of the second switch transistor T2 receives the scan signal of the previous stage OUT(N−1). The second switch transistor T2 is turned off. The pull-up control signal Q is in a floating state. When the scan is completed, the gate of the second switch transistor T2 receives the first clock signal CLK at the high voltage potential. The source of the second switch transistor T2 receives the scan signal of the previous stage OUT(N−1) at a low voltage potential. The second switch transistor T2 is turned on. The second switch transistor T2 outputs the pull-up control signal Q at the low voltage potential. The second switch transistor T2 can be a thin film transistor.

The pull-up module 12 is connected to the pull-up control module 11 for outputting a scan signal of a present stage OUT(N) at a high voltage potential according to a second clock signal CLKB and the pull-up control signal Q.

In this embodiment, the pull-up control signal Q output by the pull-up control module 11 is input to the pull-up module 12. At the same time, the pull-up module 12 receives the second clock signal CLKB. The pull-up module 12 outputs the input second clock signal CLKB to the scan signal OUT(N) according to the pull-up control signal Q. Specifically, when the pull-up module 12 receives the pull-up control signal Q at the high voltage potential and the second clock signal CLKB of the high voltage potential, the pull-up module 12 outputs the scan signal of the present stage OUT(N) at the high voltage potential. When the pull-up module 12 receives the pull-up control signal Q being at the high voltage potential and the second clock signal CLKB at a low voltage potential, the pull-up module 12 outputs the scan signal of the present stage OUT(N) at the low voltage potential. The second clock signal CLKB and the first clock signal CLK are inversed.

More particularly, the pull-up module includes a third switch transistor T3.

A gate of the third switch transistor T3 is connected to the pull-up control signal Q. A source of the third switch transistor T3 is connected to the second clock signal CLKB. A drain of the third switch transistor T3 receives the scan signal of the present stage OUT (N).

It should be noted that the gate of the third switch transistor T3 receives the pull-up control signal Q at the high voltage potential. The source of the third switch transistor T3 receives the second clock signal CLKB at the low voltage potential. The third switch transistor T3 is turned on. The drain of the third switch transistor T3 outputs the scan signal of the present stage OUT(N) at the low voltage potential. The gate of the third switch transistor T3 receives the pull-up control signal Q at the high voltage potential. The source of the third switch transistor T3 receives the second clock signal CLKB at the high voltage potential. The third switch transistor T3 is turned on. The drain of the third switch transistor T3 outputs the scan signal of the present stage OUT(N) at the high voltage potential. The third switch transistor T3 can be a thin-film transistor. The end of the third switch transistor T3 outputs the scan signal of the present stage OUT(N) is the output end of the GOA circuit.

The pull-down module 13 is connected to the pull-up module 12 and the pull-down holding module 14, respectively, for pulling down the pull-up control signal Q and the scan signal of the present stage OUT(N) to the low voltage potential when the scan is completed.

In this embodiment, during the scanning process, the pull-down module 13 is turned off. When the scan is completed, the pull-up control signal Q is pulled down to the low voltage potential and the pull-down module 13 is turned on so that the scan signal of the present stage OUT (N) is pulled down to the low voltage potential.

More particularly, the pull-down module 13 includes a fourth transistor T4.

A gate of the fourth switch transistor T4 is connected to the pull-down holding module 14. A source of the fourth switch transistor T4 receives the scan signal of the present stage OUT (N). A drain of the fourth switch transistor T4 receives a low voltage potential signal VSS.

It should be noted that during the scanning process, the pull-up control signal Q is at the high voltage potential, and the gate of the fourth switch transistor T4 receives a control signal QB reversed to the pull-up control signal Q. In other words, the gate of the fourth switch transistor T4 receives the control signal QB at a low voltage potential. The fourth switch transistor T4 is turned off. When the scan completes, the pull-up control signal Q is pulled down to the low voltage potential. The gate of the fourth switch transistor T4 receives the control signal QB at a high voltage potential. The source of the fourth switch transistor T4 receives the scan signal of the present stage OUT(N). The drain of the fourth switch transistor T4 receives the low voltage potential signal VSS. The fourth switch transistor T4 is turned on to pull down the scan signal of the present stage OUT(N) to the low voltage potential. The fourth switch transistor T4 can be a thin-film transistor.

The pull-down holding module 14 is connected to the pull-down module 13 and the pull-up control module 11, respectively, for maintaining the pull-up control signal Q and the scan signal of the present stage OUT (N) at the low voltage potential.

In this embodiment, during the scanning process, the pull-up control signal Q is at the high voltage potential. The pull-down holding module 14 outputs the control signal QB at the low voltage potential to the pull-down module 13 for turning off the pull-down module 13. When the scan completes, the pull-up control signal Q is at the low voltage potential. The pull-down holding module 14 outputs the control signal QB at the high voltage potential to the pull-down module 13 for keeping the pull-down module 13 turned on More particularly, the pull-down holding module 14 includes a fifth switch transistor T5, a sixth switch transistor T6, and a seventh switch transistor T7.

A gate of the fifth switch transistor T5 receives a high voltage potential signal VGH. A drain of the fifth switch transistor T5 is connected to the gate of the fourth switch transistor T4, a gate of the sixth switch transistor T6, and a source of the seventh switch transistor T7. A source of the sixth switch transistor T6 receives the pull-up control signal Q. A drain of the sixth switch transistor T6 receives the low voltage potential signal VSS. A gate of the seventh switch transistor T7 receives the pull-up control signal Q. A drain of the seventh switch transistor T7 receives the low voltage potential signal VSS.

It should be noted that when the pull-up control signal Q is at the high voltage potential, the seventh switch transistor T7 is turned on for pulling the control signal QB down to the low voltage potential signal VSS. The sixth switch transistor T6 is turned off. The fourth switch transistor T4 is turned off. When the pull-up control signal Q is at the low voltage potential, the seventh switch transistor T7 is turned off. The control signal QB is at the high voltage potential signal VGH. The sixth switch transistor T6 is turned on for maintaining the pull-up control signal Q at the low voltage potential. Meanwhile, the fourth switch transistor T4 is kept controlled to be turned on. The scan signal of the present stage OUT(N) is pulled down and is kept at the low voltage potential. The fifth switch transistor T5, the sixth switch transistor T6, and the seventh switch transistor T7 are thin-film transistors.

The bootstrap module 16 is connected to the pull-up control module 11 and the pull-up module 12, respectively, for pulling up the voltage potential of the pull-up control signal Q according to the scan signal of the present stage OUT (N) at the high voltage potential.

In this embodiment, the bootstrap module 16 bootstraps the pull-up control signal Q when the scan signal of the present stage OUT(N) is at the high voltage potential.

More particularly, the bootstrap module 16 includes a bootstrap capacitor C2.

One end of the bootstrap capacitor C2 receives the pull-up control signal Q. The other end of the bootstrap capacitor C2 is connected to the scan signal of the present stage OUT (N).

In this embodiment, one end of the bootstrap capacitor C2 is connected to an output end of the pull-up control module 11, and the other end of the bootstrap capacitor C2 is connected to an output end of the pull-up module 12. When the output end of the pull-up module 12 outputs the scan signal of the present stage OUT(N) at the high voltage potential, the pull-up control signal Q at the high voltage potential and the scan signal of the present stage OUT (N) at the high voltage potential are connected to two ends of the bootstrap capacitor C2. The scan signal of the present stage OUT (N) maintains the pull-up control signal Q at the high voltage potential by bootstrapping.

The control module 15 is respectively connected to the pull-up control module 11, the pull-up module 12, the pull-down holding module 14, and the bootstrap module 16 for transmitting a pulled up voltage potential of the pull-up control signal Q to the scan signal of the present stage OUT (N) in order pull up the voltage potential of the scan signal of the present stage OUT (N).

More particularly, the control module 15 is specifically utilized to be turned on after delaying for a first predetermined duration when the pull-up control module 11 outputs the pull-up control signal Q at the high voltage potential. After the voltage potential of the pull-up control signal Q is pulled up, the pulled up voltage potential of the pull-up control signal Q is transmitted to the scan signal of the present stage OUT (N) to raise the voltage potential of the scan signal of the present stage OUT (N).

In this embodiment, before the scan starts, the pull-up control signal Q is at the low voltage potential and the control module 15 is turned off. At the beginning of the scan, the pull-up control module 11 outputs the pull-up control signal Q at the high voltage potential, i.e., the pull-up control signal Q is converted from the low voltage potential to the high voltage potential. The control module 15 is not turn on immediately, but turned on from off state after a certain delay. After the control module 15 is turned on, the pull-up module 12 outputs the scan signal of the present stage OUT (N) at the high voltage potential. The bootstrap module 16 raises the potential of the pull-up control signal Q. The control module 15 can be utilized to share the pull-up control signal Q to the scan signal of the present stage OUT (N), thereby, the voltage potential of the scan signal of the present stage OUT (N) is raised.

Furthermore, the control module 15 is further configured to be turned off after delaying for a second predetermined duration when the pull-up control signal Q changes from the high voltage potential to the low voltage potential. The pull-down module 13 pulls down the scan signal of the present stage OUT(N) to the low voltage potential within the delayed second predetermined duration.

In this embodiment, when the scan completes, the pull-up control signal Q changes from the high voltage potential to the low voltage potential. The control module 15 is not immediately turned off. The control module 15 is turned off after delaying for a certain duration. During the certain delay duration, the control module 15 pulls down the scan signal of the present stage OUT(N) to the low voltage potential together with the pull-down module 13 and the pull-down holding module 14.

More particularly, the control module 15 includes a capacitor C1 and the first switch transistor T1.

The control module 15 is specifically configured to turn on the first switch transistor T1 after the delayed first predetermined duration, affected by the capacitor C1, when the pull-up control signal Q changes from the low voltage potential to the high voltage potential. The first switch transistor T1 transmits the pulled up voltage potential of the pull-up control signal Q to the scan signal of the present stage OUT(N). When the pull-up control signal Q changes from the high voltage potential to the low voltage potential, the first switch transistor T1 is turned off after the delayed second predetermined duration, affected by the capacitor C1. During the delayed second predetermined duration, the first switch transistor T pulls down the scan signal of the present stage OUT(N) to the low voltage potential together with the pull-down module 13.

One end of the capacitor C1 receives the pull-down control signal Q and the other end of the capacitor C1 is connected to the gate of the first switch transistor T1. The source of the first switch transistor T1 receives the pull-down control signal Q. The drain of the first switch transistor T1 revives the scan signal of the present stage OUT (N).

It should be noted that when the scan completes, the pull-up control signal Q is changed from the high voltage potential to the low voltage potential. The first switch transistor T1 is turned off after the delayed second predetermined duration, affected by the capacitor C1. During the delayed duration, the first switch transistor T1 and the sixth switch transistor T6 form a path as a pull-down path of the scan signal of the present stage OUT (N).

Figure 2:
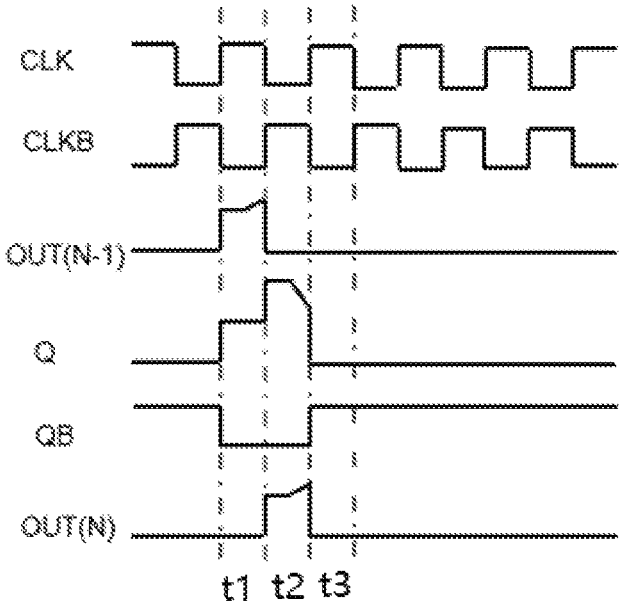
FIG. 2 illustrates a signal sequence diagram of a GOA circuit of an embodiment of the present disclosure.

The working principle of the GOA circuit of the embodiment of the present disclosure will be described in detail below with reference to FIG. 1 and FIG. 2.

In duration t1, the first clock signal CLK at the high voltage potential and the scan signal of the previous stage OUT (N−1) are both input to the second switch transistor T2. The second switch transistor T2 is turned on and outputs the pull-up control signal Q at the high voltage potential. The seventh switch transistor T7 is turned on and the control signal QB is pulled down to a low voltage potential. The first switch transistor T1 is turned on after a certain delay duration, affected by the capacitor C1. Meanwhile, the second clock signal CLKB at the low voltage potential is input to the third switch transistor T3. The third switch transistor T3 is turned on and outputs the scan signal of the present stage OUT (N) being at the low voltage potential. The driving capabilities of the first switch transistor T1 and the third switch transistor T3 determine the potential of the scan signal of the present stage OUT (N) together.

In duration t2, the first clock signal CLK at the low voltage potential and the scan signal of the previous stage OUT (N−1) are both input to the second switch transistor T2. The second switch transistor T2 is turned off. The pull-up control signal Q is in a floating state. The voltage potential of the pull-up control signal Q is determined by the first switch transistor T1, the capacitor C1 and the bootstrap capacitor C2. The second clock signal CLKB at the high voltage potential is input to the second switch transistor T3 to pull up the scan signal of the present stage OUT(N) to the high voltage potential. The bootstrap capacitor C2 pulls the voltage potential of the pull-up control signal Q up. The first switch transistor T1 is turned on after a certain duration, affected by the capacitor C1, so the pulled up voltage potential of the pull-up control signal Q is shared to the scan signal of the present stage OUT(N) in order to improve the output of the scan signal of the present stage OUT(N).

In duration t3, the first clock signal CLK at the high voltage potential and the scan signal of the previous stage OUT (N−1) are both input to the second switch transistor T2. The second switch transistor T2 is turned on and pulls the pull-up control signal Q down to the low voltage potential. The seventh switch transistor T7 is turned off and the sixth switch transistor T6 is turned on. The control signal QB is pulled up to a high voltage potential. The first switch transistor T1 is turned on and the fourth switch transistor T4 is turned on. The scan signal of the present stage OUT (N) is pulled down to a low voltage potential. Meanwhile, the first switch transistor T1 is turned on after certain duration, affected by the capacitor C1. The first switch transistor T1 forms another pull-down path to pull down the scan signal of the present stage OUT(N) before the first switch transistor T1 is turned off, thereby, the pull-down efficiency of the scan signal of the present stage OUT(N) is improved.

In one of the embodiments, the high and low voltage potentials of the first clock signal CLK are +20V and −10V respectively. The high and low voltage potential of the second clock signal CLKB are +20V and −10V respectively. The low voltage potential signal VSS is −10V. The high voltage potential signal VGH is +15V. In practical applications, the voltages of each signal can be evaluated and determined according to aspect ratios of each thin film transistors, manufacturing processes, electrical parameters of components, etc.

From the above-mentioned description, the GOA circuit provided in this embodiment disposes the control module between the pull-up control signal and the scan signal of the present stage. During the scanning, the bootstrap module raises the voltage potential of the pull-up control signal, and the control module shares the pull-up control signal to the scan signal of the present stage to raise the voltage potential of the scan signal of the present stage, thereby, the stability of the GOA circuit is enhanced. When the pull-up control signal changes from the high voltage potential to the low voltage potential, the control module is turned off after a certain delay in order to pull the scan signal of the present down to the low voltage potential together with the pull-down module during the delayed duration. As a result, the pull-down efficiency of the scan signal of the present stage is improved, which is extremely suitable for products having ultra-high resolution and high refresh rate.

Accordingly, the embodiment of the present disclosure further provides a thin-film transistor substrate which includes the GOA circuit in the above embodiments. The details are not described herein again. The embodiments of the present disclosure effectively enhance the stability of the GOA circuit.

To conclude, although the present disclosure has been disclosed by above-mentioned preferred embodiments, the above-mentioned preferred embodiments are not limitations to the present disclosure. Variations and modifications can be obtained by a person skilled in the art without departing from the aspect and scope of the present disclosure. Therefore, the protected scope of the present disclosure is subject to the scope of the claims.

What is claimed is:

1. A gate driver on array (GOA) circuit, comprising a plurality of cascaded GOA units, each stage of the GOA units comprising:

a pull-up control module configured to output a pull-up control signal which is at a high voltage potential according to a first clock signal and a scan signal of a previous stage when a scan starts;

a pull-up module configured to output a scan signal of a present stage which is at a high voltage potential according to a second clock signal and the pull-up control signal;

a bootstrap module configured to pull up a voltage potential of the pull-up control signal according to the scan signal of the present stage which is at the high voltage potential;

a control module configured to pull up a voltage potential of the scan signal of the present stage by transmitting a pulled-up voltage potential of the pull-up control signal to the scan signal of the present stage;

a pull-down module configured to pull down the voltage potential of the pull-up control signal and the voltage potential of the scan signal of the present stage to a low voltage potential when the scan is completed; and a pull-down holding module configured to maintain the voltage potential of the pull-up control signal and the voltage potential of the scan signal of the present stage at the low voltage potential;

wherein the control module is further configured to be turned on after a delayed first predetermined duration when the pull-up control module outputs the pull-up control signal which is at the high voltage potential, and is further configured to pull up the voltage potential of the scan signal of the present stage by transmitting the pulled-up voltage potential of the pull-up control signal to the scan signal of the present stage after the voltage potential of the pull-up control signal is pulled up.

2. The GOA circuit according to claim 1, wherein the control module is further configured to be turned off after a delayed second predetermined duration when the voltage potential of the pull-up control signal changes from the high voltage potential to the low voltage potential, and is further configured to pull down the scan signal of the present stage to the low voltage potential together with the pull-down module within the delayed second predetermined duration.

3. The GOA circuit according to claim 2, wherein the control module comprises a capacitor and a first switch transistor;

the control module is further configured to turn on the first switch transistor after the delayed first predetermined duration, affected by the capacitor, when the pull-up control signal changes from the low voltage potential to the high voltage potential, wherein the first switch transistor transmits the pulled-up voltage potential of the pull-up control signal to the scan signal of the present stage; and the first switch transistor is turned off after the delayed second predetermined duration, affected by the capacitor, when the pull-up control signal changes from the high voltage potential to the low voltage potential, and the first switch transistor pulls down the scan signal of the present stage to the low voltage potential together with the pull-down module within the delayed second predetermined duration.

4. The GOA circuit according to claim 3, wherein one end of the capacitor receives the pull-down control signal and another end of the capacitor is connected to a gate of the first switch transistor, a source of the first switch transistor is connected to the pull-down control signal, and a drain of the first switch transistor receives the scan signal of the present stage.

5. The GOA circuit according to claim 1, wherein the bootstrap module comprises a bootstrap capacitor; and one end of the bootstrap capacitor receives the pull-up control signal and another end of the bootstrap capacitor receives the scan signal of the present stage.

6. The GOA circuit according to claim 1, wherein the pull-up control module comprises a second switch transistor; and a gate of the second switch transistor receives the first clock signal, a source of the second switch transistor receives the scan signal of the previous stage, and a drain of the second switch transistor outputs the pull-up control signal.

7. The GOA circuit according to claim 1, wherein the pull-up module comprises a third switch transistor; and a gate of the third switch transistor receives the pull-up control signal, a source of the third switch transistor receives the second clock signal, and a drain of the third switch transistor outputs the scan signal of the present stage.

8. The GOA circuit according to claim 1, wherein the pull-up module comprises a fourth switch transistor; and a gate of the fourth switch transistor is connected to the pull-down holding module, a source of the fourth switch transistor receives the scan signal of the present stage, and a drain of the fourth switch transistor receives a low-voltage potential signal.

9. The GOA circuit according to claim 8, wherein the pull-down holding module comprises a fifth switch transistor, a sixth switch transistor, and a seventh switch transistor; and a gate of the fifth switch transistor and a drain of the fifth switch transistor receive a high-voltage potential signal, a source of the fifth switch transistor is connected to the gate of the fourth switch transistor, a gate of the sixth switch transistor, and a source of the seventh switch transistor, a source of the sixth switch transistor receives the pull-up control signal, a drain of the sixth switch transistor receives the low-voltage potential signal, a gate of the seventh switch transistor receives the pull-up control signal, and a drain of the seventh switch transistor receives the low-voltage potential signal.

10. A thin film transistor (TFT) substrate, comprising a gate driver on array (GOA) circuit, wherein the GOA circuit comprises a plurality of cascaded GOA units, and each stage of the GOA units comprises:

a pull-up control module configured to output a pull-up control signal which is at a high voltage potential according a first clock signal and a scan signal of a previous stage when a scan starts;

a pull-up module configured to output a scan signal of a present stage which is at a high voltage potential according to a second clock signal and the pull-up control signal;

a bootstrap module configured to pull up a voltage potential of the pull-up control signal according to the scan signal of the present stage which is at the high voltage potential;

a control module configured to pull up a voltage potential of the scan signal of the present stage by transmitting a pulled-up voltage potential of the pull-up control signal to the scan signal of the present stage;

a pull-down module configured to pull down the voltage potential of the pull-up control signal and the voltage potential of the scan signal of the present stage to a low voltage potential when the scan is completed; and a pull-down holding module configured to maintain the voltage potential of the pull-up control signal at the low voltage potential and the voltage potential of the scan signal of the present stage at the low voltage potential;

wherein the control module is further configured to be turned on after a delayed first predetermined duration when the pull-up control module outputs the pull-up control signal which is at a high voltage potential, and is further configured to pull up the voltage potential of the scan signal of the present stage by transmitting the pulled-up voltage potential of the pull-up control signal to the scan signal of the present stage after the voltage potential of the pull-up control signal is pulled up.

11. The TFT substrate according to claim 10, wherein the control module is further configured to be turned off after a delayed second predetermined duration when the voltage potential of the pull-up control signal changes from the high voltage potential to the low voltage potential, and is configured to pull down the scan signal of the present stage to the low voltage potential together with the pull-down module within the delayed second predetermined duration.

12. The TFT substrate according to claim 11, wherein the control module comprises a capacitor and a first switch transistor;

the control module is further configured to turn on the first switch transistor after the delayed first predetermined duration, affected by the capacitor, when the pull-up control signal changes from the low voltage potential to the high voltage potential, wherein the first switch transistor transmits the pulled-up voltage potential of the pull-up control signal to the scan signal of the present stage; and the first switch transistor is turned off after the delayed second predetermined duration, affected by the capacitor, when the pull-up control signal changes from the high voltage potential to the low voltage potential, and the first switch transistor pulls down the scan signal of the present stage to the low voltage potential together with the pull-down module within the delayed second predetermined duration.

13. The TFT substrate according to claim 12, wherein one end of the capacitor receives the pull-down control signal and another end of the capacitor is connected with a gate of the first switch transistor, a source of the first switch transistor is connected with the pull-down control signal, and a drain of the first switch transistor receives the scan signal of the present stage.

14. The TFT substrate according to claim 10, wherein the bootstrap module comprises a bootstrap capacitor; and one end of the bootstrap capacitor receives the pull-up control signal and another end of the bootstrap capacitor receives the scan signal of the present stage.

15. The TFT substrate according to claim 10, wherein the pull-up control module comprises a second switch transistor; and a gate of the second switch transistor receives the first clock signal, a source of the second switch transistor receives the scan signal of the previous stage, and a drain of the second switch transistor outputs the pull-up control signal.

16. The TFT substrate according to claim 10, wherein the pull-up module comprises a third switch transistor; and a gate of the third switch transistor receives the pull-up control signal, a source of the third switch transistor receives the second clock signal, and a drain of the third switch transistor outputs the scan signal of the present stage.

17. The TFT substrate according to claim 10, wherein the pull-up module comprises a fourth switch transistor; and a gate of the fourth switch transistor is connected to the pull-down holding module, a source of the fourth switch transistor receives the scan signal of the present stage, and a drain of the fourth switch transistor receives a low-voltage potential signal.

18. The TFT substrate according to claim 17, wherein the pull-down holding module comprises a fifth switch transistor, a sixth switch transistor and a seventh switch transistor; and a gate of the fifth switch transistor and a drain of the fifth switch transistor receive a high-voltage potential signal, a source of the fifth switch transistor is connected to the gate of the fourth switch transistor, a gate of the sixth switch transistor, and a source of the seventh switch transistor, a source of the sixth switch transistor receives the pull-up control signal, a drain of the sixth switch transistor receives the low-voltage potential signal, a gate of the seventh switch transistor receives the pull-up control signal, and a drain of the seventh switch transistor receives the low-voltage potential signal.

* * * * *